United States Patent [19]

Slaats et al.

[11] Patent Number: 4,593,951

[45] Date of Patent: Jun. 10, 1986

[54] HYDRAULIC CHAIR LIFT MECHANISM

[75] Inventors: Mathew A. Slaats; Patrick E. Strange, both of Jasper, Ind.

[73] Assignee: Kimball International, Inc., Jasper, Ind.

[21] Appl. No.: 668,307

[22] Filed: Nov. 5, 1984

[51] Int. Cl.[4] ..... A47C 1/02

[52] U.S. Cl. ..... 297/347; 297/DIG. 3; 297/339; 108/147; 248/560

[58] Field of Search ..... 297/347, 349, 339, DIG. 3, 297/DIG. 10; 248/560, 566, 576, 575, 603, 605, 616, 404; 108/147; 254/93 R, 93 HP

[56] References Cited

U.S. PATENT DOCUMENTS

| | | | |
|---|---|---|---|
| 247,142 | 9/1881 | Woods . | |
| 1,651,506 | 12/1927 | Berninghaus . | |
| 2,490,823 | 12/1949 | Manning | 91/4 R |
| 2,906,095 | 9/1959 | Whitehead, Jr. | 60/592 |
| 2,961,033 | 11/1960 | Galbraith | 248/575 |
| 3,005,444 | 10/1961 | Steibel | 60/591 |
| 3,143,332 | 8/1964 | Watlington . | |
| 3,226,931 | 1/1966 | Bauer | 60/593 |
| 3,286,970 | 11/1966 | Nolan | 248/404 |
| 3,381,926 | 5/1968 | Fritz et al. . | |
| 3,594,040 | 7/1971 | Monroe . | |
| 3,861,740 | 1/1975 | Tajima et al. | 297/195 |
| 4,074,887 | 2/1978 | Hale . | |
| 4,124,202 | 11/1978 | Hatakeyama | 267/118 |
| 4,139,175 | 2/1979 | Bauer . | |
| 4,445,671 | 5/1984 | Reuschenbach et al. . | |

FOREIGN PATENT DOCUMENTS

| | | | |
|---|---|---|---|
| 783416 | 4/1968 | Canada . | |
| 1605908 | 5/1969 | Fed. Rep. of Germany | 248/571 |
| 1605927 | 8/1978 | Fed. Rep. of Germany | 248/575 |
| 70218 | 5/1969 | German Democratic Rep. | 248/616 |
| 1151262 | 7/1966 | United Kingdom . | |

*Primary Examiner*—James T. McCall

*Attorney, Agent, or Firm*—Jeffers, Irish & Hoffman

[57] ABSTRACT

A hydraulic lifting mechanism for an article of furniture comprising a pair of sealed chambers interconnected with a hollow conduit and containing hydraulic fluid. One of the chambers is expandable and comprises flexible walls in the form of a rolling diaphragm. The second chamber contains a pressurized gas in addition to a hydraulic fluid. The expandable chamber is located in the supporting base of the article of furniture. A two speed valve is included in the interconnecting conduit for allowing fluid transfer between the chambers at a first rate in one direction and at a second rate in the other direction. As fluid is transferred to the expandable chamber, a support column will be forced upwardly by the expanding chamber at a fast rate and when the fluid transfers from the expandable chamber to the second chamber the support column will move downwardly at a second rate of speed slower than the first rate. The second chamber and the control valve can be located remotely from the base of the article of furniture.

51 Claims, 7 Drawing Figures

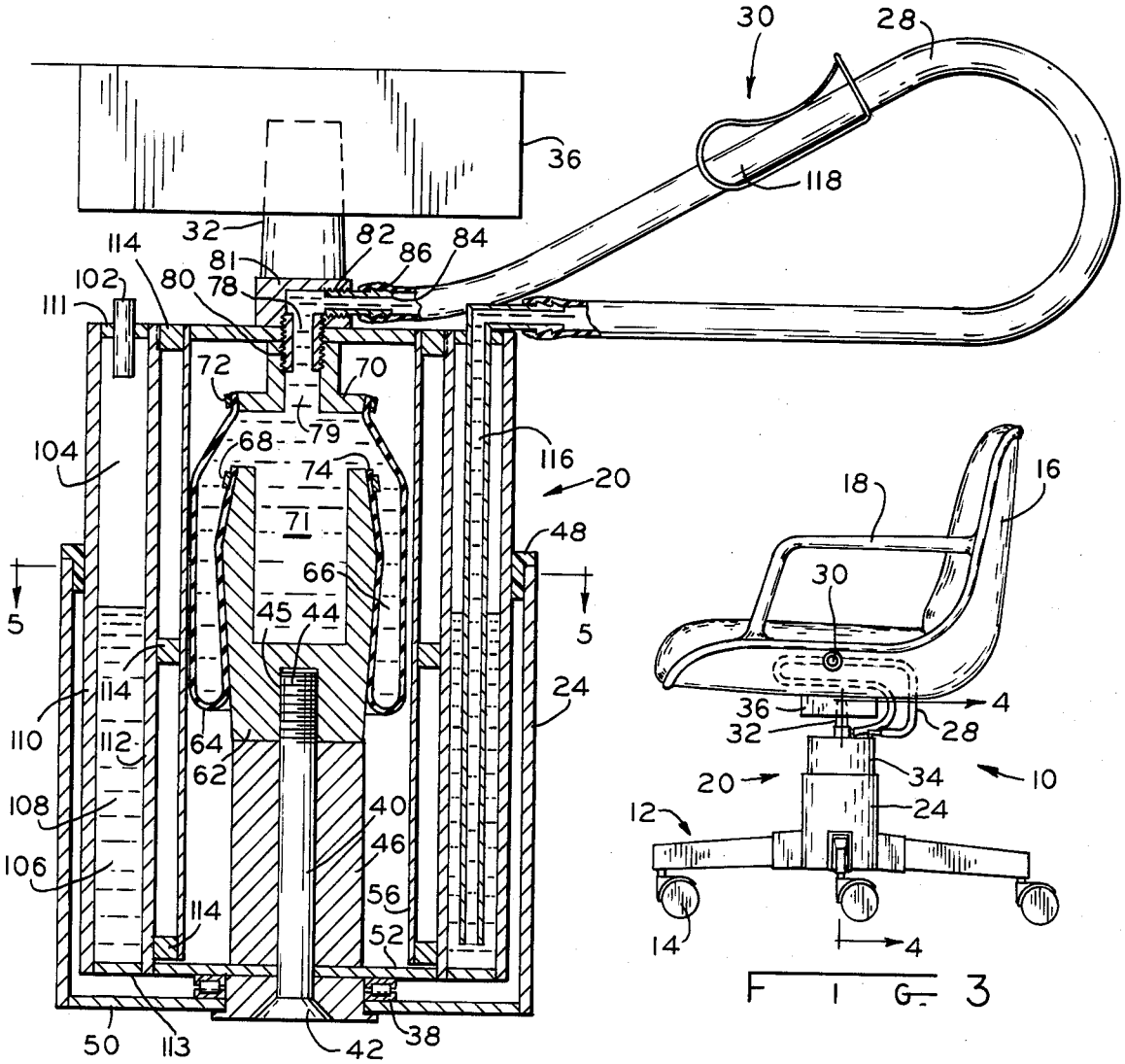
FIG. 4
FIG. 3
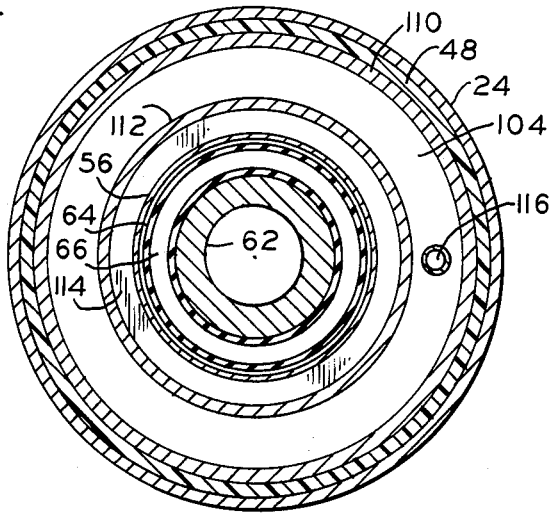
FIG. 5

HYDRAULIC CHAIR LIFT MECHANISM

BACKGROUND OF THE INVENTION

This invention pertains to a hydraulic lifting mechanism for an article of furniture wherein a hydraulic power unit is provided for raising and lowering a retractable support member for supporting a chair seat or the like.

It is desirable in certain articles of furniture, such as chairs, to provide a mechanism for adjusting the height of a supporting member as for example the height of a chair seat whereby the chair occupant can select a height of the seat best suited for him. Prior art structures have been provided for this purpose and those structures have in general comprised a pair of rigid walled hydraulic fluid filled chambers which communicate with each other by means of a hollow conduit. One of the chambers is expandable so as to have a variable volume and the other chamber contains a compressed gas whereby the hydraulic fluid can be transferred from the pressurized chamber to the expandable chamber when a control valve in the hollow conduit is opened. As the fluid volume in the expandable chamber increases, the support member will be urged upwardly, thereby raising the chair seat. Control means are provided to control the hollow conduit valve to enable transfer of fluid between the chambers. The chair seat is returned to its retracted position by transferring fluid from the variable volume chamber to the pressurized chamber. As the expandable chamber is compressed the volume of that chamber is reduced thereby causing the fluid to be forced out of that chamber and into the pressurized chamber.

One prior art patent showing the structure hereinabove described is U.S. Pat. No. 4,074,887. This patent shows two circumferentially arranged chambers with the outer chamber comprising a rigid walled sealed chamber containing hydraulic fluid and containing a pressurized gas in a top portion thereof. The inner chamber is a rigid walled expandable chamber containing only hydraulic fluid. A control lever is provided for controlling a valve to enable hydraulic fluid to be transferred by means of the gas pressure from the outer chamber to the inner chamber. A piston in the expandable chamber is raised and lowered by operation of the control valve and transfer of the hydraulic fluid between the chambers.

A disadvantage of this prior art structure is that the sliding seals needed to seal the piston in the chamber are subject to wear and leakage and, as hydraulic fluid leaks out of the mechanism, the volume of hydraulic fluid in the mechanism is reduced. The pressurized gas in the outer chambers will then occupy a greater volume, thereby reducing its pressure and causing the upward speed of the mechanism to decrease and the upward force on the support and chair seat to be reduced, both of which results are undesirable. Furthermore, the lost hydraulic fluid needs to be replaced from time to time so that the mechanism requires servicing, which is undesirable. It is therefore desirable to provide a pneumatic lifting mechanism wherein no sliding seals are provided and which is not subject to leakage and loss of hydraulic fluid.

A further disadvantage of the prior art structures has been that the control for adjusting the lifting mechanism has been located adjacent to the mechanism. The prior art arrangements have necessitated the occupant of the chair to lean over and reach far under the chair seat, or have necessitated long control arms to adjust the chair height. It is desirable to provide a lifting mechanism wherein the control can be located in the chair arm or adjacent the seat so that it is more easily operable.

A yet further disadvantage of the prior art structures has been the provision of rather complicated valves to control the transfer of hydraulic fluid between the chambers. It is therefore desirable to provide a mechanism including a valve which is simple yet reliable and effective.

U.S. Pat. No. 4,445,671 discloses an adjustable pneumatic mechanism for an article of furniture which prevents rapid dropping of the support platform. A pressure sensitive valve is provided which allows fluid to flow in one direction, but which prevents fluid flow in the opposite direction if excessive pressures are encountered in the hydraulic mechanism. Thus, if a heavy weight is placed on the platform, causing a high pressure to be developed in the hydraulic fluid, the valve will shut and prevent rapid descent of the mechanism and potential injury to the operator. The disadvantage of this structure is that the valve mechanism is rather complicated. It is therefore desired to provide a lifting mechanism wherein a simple and reliable control valve allows for a larger rate of fluid flow in one direction than in the reverse direction so that the ascent of the hydraulic mechanism is accomplished at a rapid rate, whereas the descent of the mechanism will occur much more slowly, thereby preventing injury to the operator and also permitting the operator to stop the descent of the mechanism at the exact desired point.

In some of the prior art pneumatic lifting mechanisms, only a gas rather than an incompressible hydraulic fluid is used to provide the lifting functions of the mechanism. These types of mechanisms are subject to leakage of gas from the mechanism and also result in a spongy action of the mechanism since the gas is compressible. It is desired to provide a very positive lifting mechanism not subject to leakage of the working fluid or having spongy action and wherein the hydraulic working fluid is incompressible.

In still other prior art mechanisms a manual or electric pump is provided to pump hydraulic fluid to the expanding chamber to cause the lifting action. Such pumps are subject to failure and are also costly. It is therefore desirable to provide a mechanism wherein no pumps are needed to transfer fluid between the two chambers.

SUMMARY OF THE INVENTION

The present invention, in one form thereof, overcomes the disadvantages of the above-described prior art lifting mechanisms by providing an improved lifting mechanism therefor. The lifting mechanism of the present invention comprises two chambers or tanks, containing hydraulic fluid, one of which is a variable volume chamber comprising a flexible diaphragm. The other chamber contains both a hydraulic fluid and a pressurized gas. A conduit interconnects the two chambers and includes a control valve for enabling and disabling fluid transfer between the two chambers.

The present invention, in one form thereof, comprises a base, a flexible diaphragm variable volume chamber supported by the base and containing a hydraulic liquid and a support member carrying a platform. The mechanism further includes a second chamber which may comprise a rigid walled chamber containing a hydraulic fluid and a pressurized gas. A conduit interconnects the two chambers and includes a control valve for permitting fluid to transfer between the two chambers. When the valve is opened and no force acts downwardly on the variable volume chamber, the fluid will transfer under gas pressure from the fixed volume chamber to the variable volume chamber. As the volume of fluid in the variable volume chamber increases, the fluid volume will occupy more space and the chamber will be forced to expand in the upward direction thereby placing an upward force on a support member and support platform and urging those parts upwardly.

The invention, in one form thereof, further comprises a chair having a base and a seat. A lifting mechanism is disposed between the base and the seat. The mechanism comprises a flexible walled chamber and a second chamber. The chambers are interconnected by a conduit. The chambers contain hydraulic fluid and the conduit has a control valve therein for enabling and disabling fluid transfer between the two chambers. The second chamber contains a pressurized gas for forcing hydraulic fluid out of the second chamber into the flexible walled chamber when the control valve is opened and no downward force acts on the flexible walled chamber. The flexible walled chamber is confined against downward and sideward expansion. As the volume of fluid contained in the flexible walled chamber increases and the chamber expands upwardly an upward force is generated by the expanding volume thereby forcing the chair seat upwardly. The control valve has a higher fluid flow rate in one direction than in the reverse direction whereby the rate of upward travel of the chair seat is greater than the downward travel rate thereby preventing injury to the occupant and allowing the occupant to accurately position the chair seat. The control is located in an arm of the chair to permit the user to easily adjust the chair seat height. Furthermore, the second chamber is located in the arm of the chair whereby the mechanism in the base of the chair is not bulky and occupies little space.

An advantage of the present invention is that the mechanism operates without the use of sliding seals thereby eliminating potential leakage, reducing the need for service and extending the life of the mechanism.

Another advantage of the mechanism of one form of the present invention is that the control can be located remotely from the mechanism in any desired position in the article of furniture.

Yet another advantage of the mechanism according to one form of the present invention is that the fixed volume tank can be located remotely from the mechanism thereby permitting the mechanism to occupy little space in the base of the furniture article.

Still another advantage of the chair according to the present invention is the provision of a simple and reliable valve having two flow rates whereby the upward and downward movement of the article of furniture occurs at two different rates of speed, thereby preventing injury to the occupant of the chair and allowing accurate adjustment of the chair seat height.

A still further advantage of the mechanism according to one embodiment of the present invention is the simplicity of construction.

A yet further advantage of the mechanism according to the present invention is that rotation of the chair is effected in the bottom portion of the base mechanism whereby the chambers and the control valve will rotate together with the chair seat, thereby allowing the control valve and the second chamber to be located remotely from the base of the chair.

The invention, in one form thereof, comprises a hydraulic lifting mechanism for adjustably supporting an article of furniture and comprises a base and a reciprocable support member moveable between extended and retracted positions. The mechanism further includes a first fluid filled chamber and a second fluid filled chamber including a flexible wall, the volume of the second chamber being variable, the second chamber being supported by the base and the reciprocable member being supported by the second chamber. The reciprocable member reciprocates and responds to variations in the variable volume. Conduit means connects the first chamber to the second chamber and control valve means is provided in the conduit means for selectively enabling the conduit to transfer fluid between the chambers.

The invention, in one form thereof, also provides a chair height adjustment mechanism comprising a base member, and a first hollow member supported on the base. The hollow member comprises a flexible diagram wall member and a cover member sealingly secured to the wall member. The first hollow member contains a liquid and a vertically reciprocable support member is supported on the first hollow member. A chair seat is supported on the support member and is vertically reciprocable therewith. A second hollow member contains a liquid and a pressurized gas, the second hollow member is located remote from the first hollow member, the base and the support member. A hollow conduit connects the first and second hollow members and includes valve means for selectively enabling the conduit to transfer fluid between the two hollow members whereby the change in the volume of fluid contained in the first hollow member causes the chair seat to move vertically.

The invention, in one form thereof, further provides a hydraulic lifting mechanism for supporting an article of furniture and comprises a base member and a support column secured to the base. The mechanism comprises a variable volume chamber, supported by the column and containing a liquid, the chamber comprising a flexible bag means. A support member is supported by the variable volume chamber. A fixed volume chamber means contains a liquid and a pressurized gas and is disposed in the article of furniture. A conduit means for connecting the two chambers and for transferring fluid therebetween contains a control means for controlling fluid transfer between the two chambers, the control means being positioned remote from the base and the variable volume chamber.

The invention, in one form thereof, comprises a hydraulic chair lift mechanism comprising a base, a rotatable support member rotatably supported by the base, a sealed flexible bag member supported by the support member and a chamber. The bag and the chamber contain a hydraulic incompressible fluid and the chamber furthermore includes a pressurized gas disposed above the hydraulic fluid. Hollow conduit means is provided interconnecting the bag and the chamber for transferring hydraulic fluid between the bag and the chamber and a control valve means is included in the conduit for enabling the fluid transfer. The fluid transfer from the chamber to the bag is at a first flow rate and the fluid transfer from the bag to the chamber is at a second flow rate less than the first flow rate.

The invention, in one form thereof, also comprises a method for reciprocably supporting an article of furniture including a base, and a column mounted on the base and a support member supported by the column and a tank. The method comprises supporting a fluid filled flexible bag member intermediate the column in the support member and connecting the bag to the tank with the hollow conduit means. The method further comprises partially filling the tank with a hydraulic fluid, pressurizing the tank with a gas and transferring the hydraulic fluid between the bag and the chamber for reciprocating the support member.

It is an object of the present invention to provide a simple reliable hydraulic lifting mechanism for an article of furniture.

It is another object of the present invention to provide a hydraulic lifting mechanism for an article of furniture wherein no sliding seals are used.

It is another object of the present invention to provide a mechanism for hydraulically lifting an article of furniture wherein a flexible diaphragm member is used as one of the chambers.

It is still another object according to the present invention to provide a mechanism for hydraulically lifting an article of furniture wherein the control is located remotely from the base of the article of furniture.

A still further object of the present invention is to provide a hydraulic mechanism for lifting a chair wherein the rigid walled chamber is located remotely from the mechanism.

A yet further object of the present invention is to provide a hydraulic lifting mechanism for a chair wherein the control valve has two flow rates whereby two adjustment speeds of the mechanism are provided and whereby the ascent speed of the chair seat is faster than the descent speed.

Yet another further object of the present invention is to provide a hydraulic lifting mechanism for a chair wherein no pumps are needed to transfer the hydraulic fluid between chambers.

Yet still a further object of the present invention is to provide a mechanism which is reliable, simple to operate and inexpensive to construct.

BRIEF DESCRIPTION OF THE DRAWINGS

The above mentioned and other features and objects of the this invention and the manner of attaining them will become more apparent and the invention itself will be better understood by reference to the following description of an embodiment of the invention taken in conjunction with the accompanying drawings, wherein:

FIG. 3 a perspective view of a chair incorporating an embodiment of the present invention wherein the tanks are in concentric relationship;

FIG. 4 is a sectional view of the pneumatic lifting mechanism of FIG. 3 taken along the line 4—4 of FIG. 3;

FIG. 5 is a sectional view of the hydraulic lifting mechanism of FIG. 4 taken along the line 5—5;

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
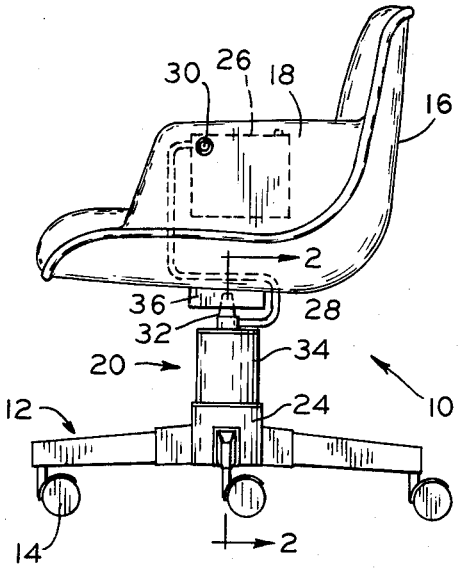
FIG. 1 is a perspective view of a chair incorporating a preferred embodiment of the present invention with a remotely located pressurized tank.

Referring to FIG. 1 a chair assembly 10 is shown comprising a base 12 including casters 14. A seat 16 is supported on the base and has an arm 18. The pneumatic lifting mechanism 20 is shown located below the seat 16 and intermediate the seat 16 and base 12. Mechanism 20 comprises a lower cylindrical housing cover 24 and an upper cylindrical housing cover 34. A sealed tank or chamber 26 is shown located in arm 18 and a hollow conduit 28 is shown leading from tank 26 to mechanism 20. A control 30 is shown located on the side of arm 18 for controlling the operation of mechanism 20 as further explained hereinbelow. A reciprocable support shaft 32 is provided at the upper end of mechanism 20 for reciprocably supporting a support platform 36 upon which chair seat 16 rests.

Figure 2:
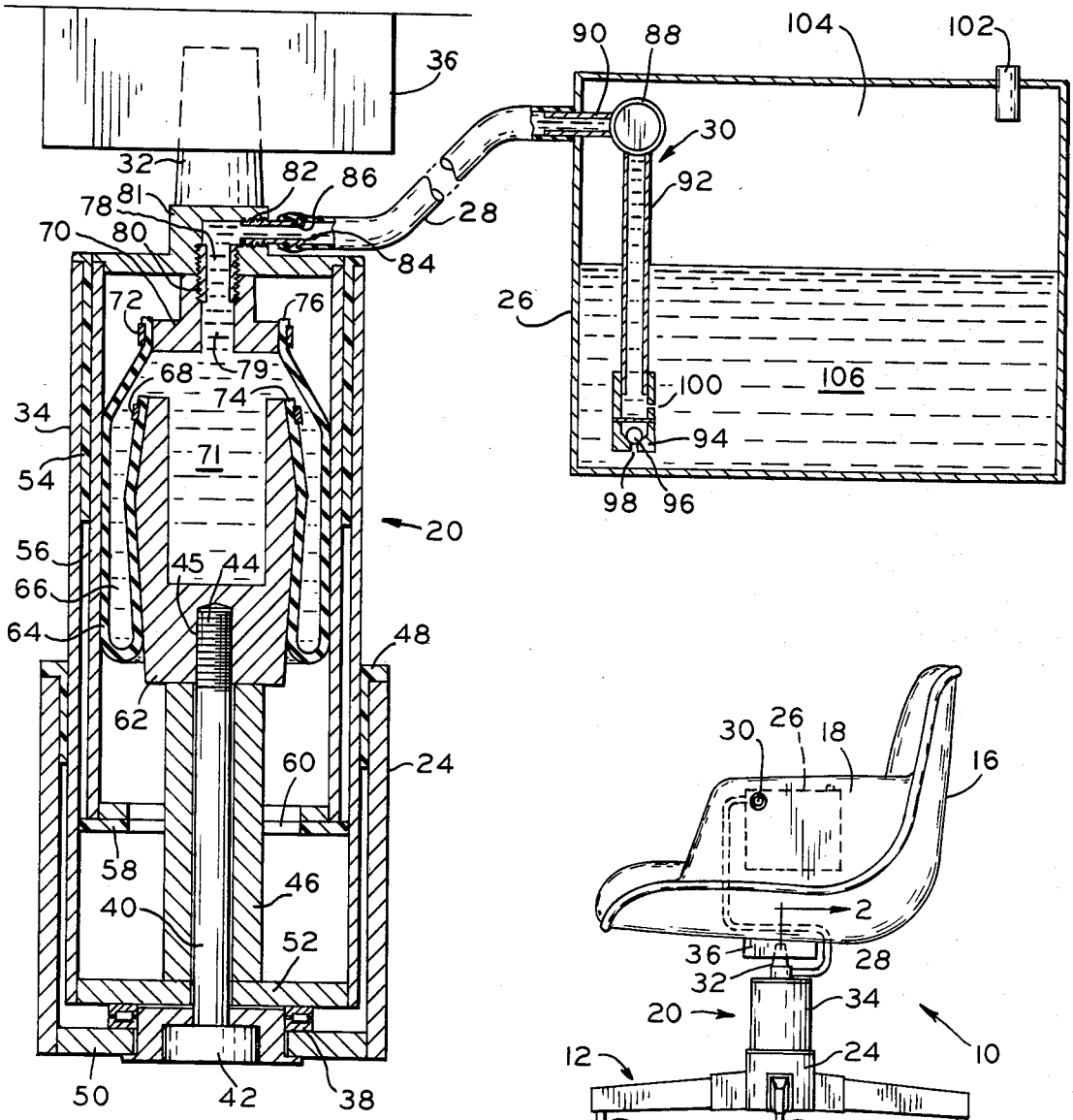
FIG. 2 is a sectional view of the pneumatic lifting mechanism of FIG. 1 taken along the line 2—2 of FIG. 1.

Mechanism 20, in a preferred embodiment, is shown in FIG. 2 as follows. A thrust bearing 38 is located in a lower portion of the mechanism, adjacent base 12 for rotatably supporting the lifting mechanism and the chair seat. Thrust bearing 38 rests on a bottom portion 50 of cylindrical housing portion or shroud 24. Rotating shaft 40 extends upwardly from an enlarged portion 42 located in the bottom portion of housing portion 24, and has an upper portion 44 secured in aperture 45. A sleeve bearing 48 having a flange thereon is positioned between housing cover portions 24 and 34 to act as a bearing surface therebetween. Housing portion 34 or shroud can therefore rotate with respect to housing portion 24. Housing portions 24 and 34 are preferably cylindrical in shape. A guide tube 46 extends upwardly from a supporting bottom portion 52 of housing portion 34 to prevent lateral movement of shaft 40. A telescoping tube member 56 is slidably reciprocably received within housing portion 34. Spacer 54 is inserted between housing portion 34 and inner tube 56 and serves as a sleeve bearing surface therebetween. Thus, housing portion 24, bottom 50 and the bottom race of bearing 38 are stationary. Housing portion 34, top race of bearing 38, shaft 42, bottom portion 52, tube 46, support member 62, and telescoping tube 56 rotate together and are supported by bearing 38.

A bottom portion 58 of telescoping inner tube 56 has an aperture 60 provided therein to provide clearance between support member 62 and bottom portion 58 as bottom portion 58 travels upwardly. While bearing 38 has been shown located in the lower portion of the mechanism it should be understood that bearing 38 can also be located upwardly in the mechanism. For instance, aperture 45 could be provided with a ball bearing so that upper portion 44 of shaft 40 is stationary and member 62 rotates with respect to shaft 40.

Figure 6:
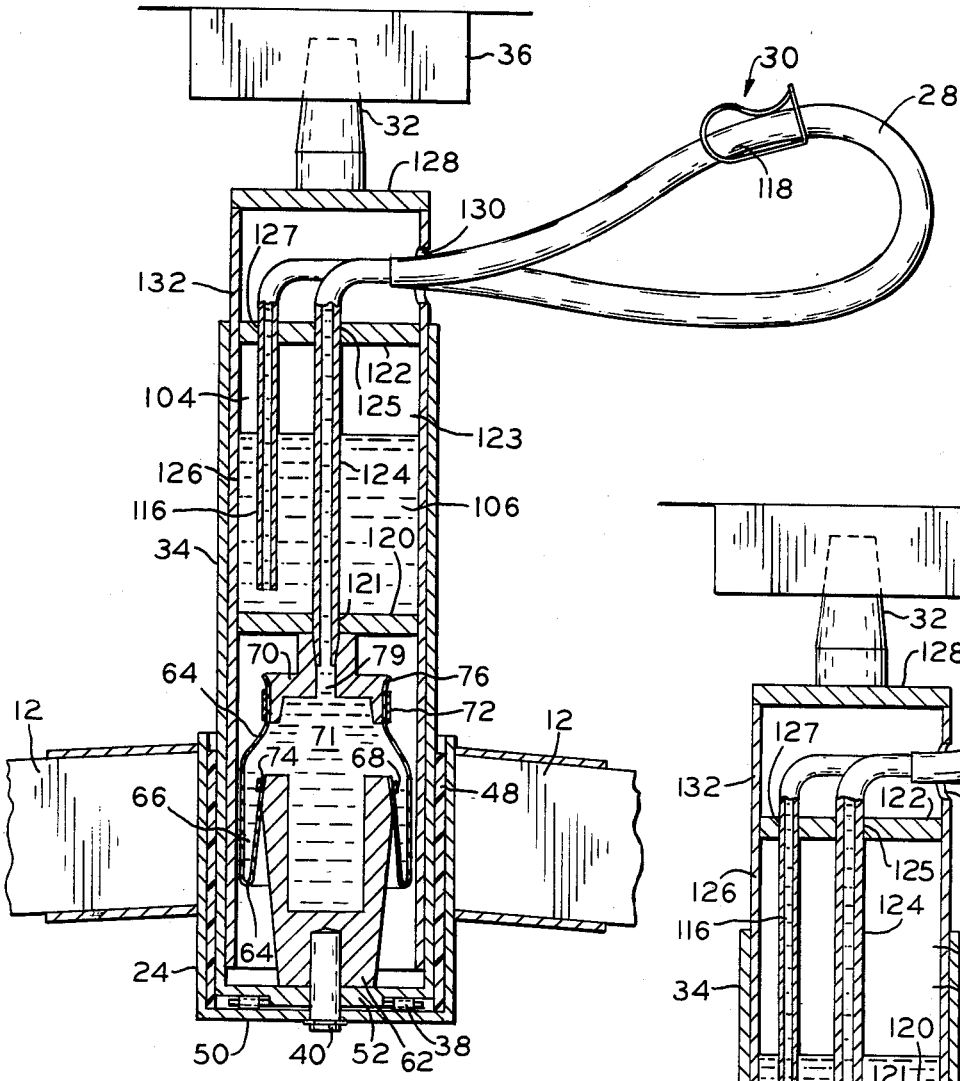
FIG. 6 is a sectional view of an embodiment of the present invention wherein the tanks are disposed in stacked relationship.
Figure 7:
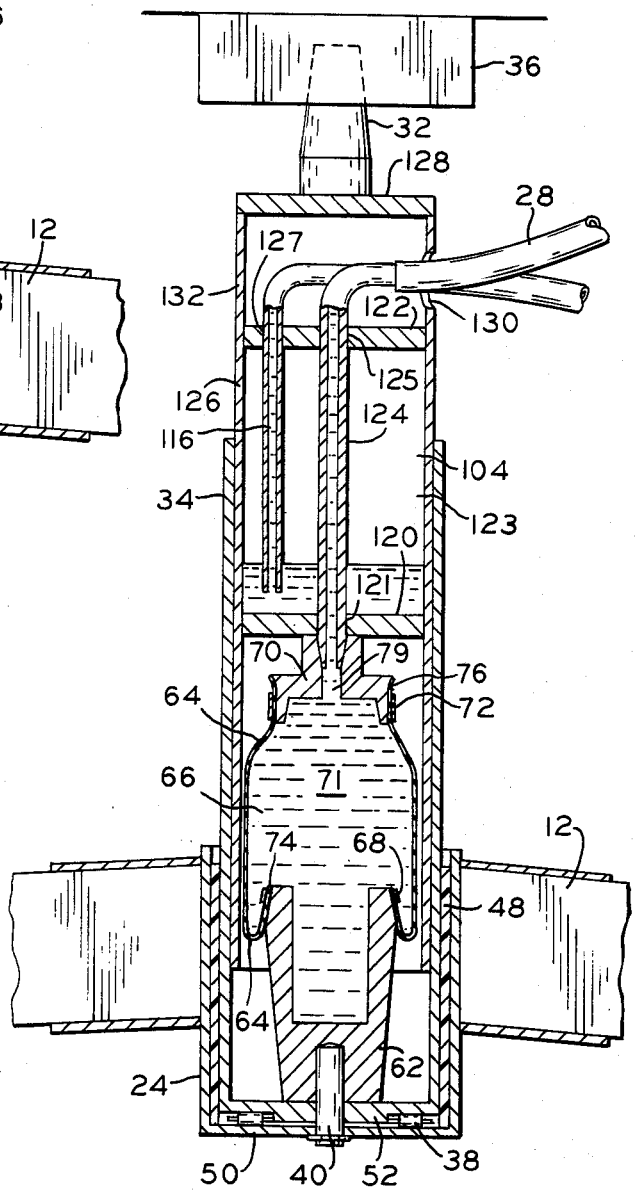
FIG. 7 is a sectional view of the embodiment of FIG. 6 with the expandable tank in its expanded position.

A diaphragm or sock 64 is provided in the upper portion of cover 34 and is sealingly connected to an upper portion of support member 62. Diaphragm 64 is in the form of a rolling sock or flexible bag and encloses a volume which is variable. The volume of the bag is increased by rolling the sides thereof so that the sides no longer fold in upon themselves as shown in Fig. 6 but instead are extended as shown in FIG. 7 and further described hereinafter. Support member 62 has an aperture 45 therein for rotatably receiving portion 44 of shaft 40. The upper portion of support member 62 has an undercut portion 74 whereby the edge portion of diaphragm 64 is captured thereby and retained therein by means of crimp ring 68 to make a sealing connection between diaphragm 64 and support member 62.

The opposite end of diaphragm 64 is sealingly connected by means of a crimp ring to a plug 70 received in the upper opening of diaphragm 64. Plug 70 has an undercut portion 76 whereby diaphragm 64 is sealingly captured in this undercut portion and is secured to plug 70 by means of crimp ring 72. It can be seen that this arrangement provides for the flexible bag 64 to have a variable volume 71. The advantage of this novel rolling sock chamber 64 is the provision of a variable volume chamber without the need for sliding seals as required by the prior art structures and as described hereinabove. The sock or bag 64 is sealed to plug 70 and support member 62 by means of a very simple and reliable sealing structure without the need for moving parts. The rolling action of diaphragm 64 permits the elimination of sliding seals yet retains the advantages of a variable volume chamber in a lifting mechanism.

Incompressible hydraulic fluid 66 is provided for filling the volume 71. Flexible walled chamber 64 is confined in tube 56 and supported by member 62. The expansion of volume 71 must therefore take place in the upward direction when incompressible hydraulic fluid is added to volume 71. As the volume expands chamber 64 in the upward direction, the expansion will generate an upward lifting force on support shaft 32 and platform 36 to lift chair seat 16.

Similarly, when a downward force acts on platform 36, and is transmitted by shaft 32 to bag 64, the hydraulic fluid will be forced out of bag 64 to return to chamber 26 and thereby allowing seat 16 to descend. As explained hereinafter, a valve is used to control transfer of fluid between the chambers.

Continuing to refer to FIG. 2, it can be seen that an aperture 79 is provided in plug 70 for allowing ingress and egress of hydraulic fluid to and from volume 71. A threaded fitting 78 is provided for engagement with threaded portion 80 of plug 70. Another threaded fitting 82 is provided in top support member 81 at right angles to fitting 78. Annular upstanding ridges 86 are provided on portion 84 of fitting 82 to engage with tube 28 and to secure tube 28 to fitting 82 as is conventional. Tube 28 is shown with a break therein to indicate that tube 28 can be of any desired length. In the described embodiments chamber 26 has rigid walls and is shown located remotely from mechanism 20. However, it should be understood that tank 26 may have either a fixed or variable volume and may have either flexible or rigid walls, since the function of tank 26 is to serve as holding reservoir for hydraulic working fluid. Tank 26 can be located at any location in the chair or remote therefrom. As illustrated in FIG. 1, the tank is located in the arm 18 of the chair. However, it should be understood that tank 26 can be located at any convenient location either within the article of furniture or outside of it. For instance, if the article furniture in which the mechanism is to be used were a table, tank 26 could conveniently be mounted underneath the table top.

Chamber 26 is sealed with the exception of an opening through which tube 28 extends by means of a fitting 90. Chamber 26 contains incompressible hydraulic fluid 106 above which pressurized gas 104 is provided. A fitting 102 is sealingly secured in a top portion of the tank for permitting hydraulic fluid gas to be inserted into tank 26. A control valve 30 is provided for the mechanism and in this embodiment is shown as being completely housed in tank 26. It should be understood that the valving mechanism can be provided at any convenient location such as for instance in tube 28.

Continuing now with reference to FIG. 2, it can be seen that valving mechanism 30 comprises an ON/OFF valve 88, a connecting tube 92, a check valve 94 and a bypass orifice 100. Check valve 94 includes a check valve ball 96 to seal orifice 98 when fluid flow is into tank 26. In the preferred embodiment, orifice 100 is much smaller than orifice 98. It should be readily apparent to those skilled in the art that different types of check valves and ON/OFF valves may be used with this mechanism. Orifice 100 is a small passage for bypassing check valve 94.

In the operation of valving mechanism 30, it can be seen that, when valve 88 is opened, liquid is allowed to pass through tube 92. If in the illustrated embodiment the flow of liquid is in the upward direction, fluid pressure on ball 96 will move it away from orifice 98 whereby fluid will enter tube 92 through orifice 98 and orifice 100. However, when the flow of fluid is in the opposite or downward direction pressure on ball 96 will cause it to seat in orifice 98 thereby closing off the orifice so that fluid can only pass from tube 92 into chamber 26 by means of bypass orifice 100. Valving mechanism 30 therefore comprises a reliable and simple valve structure having a greater fluid flow rate in one direction than the opposite direction.

It should be noted that location of the orifices in valving mechanism 30 allows only incompressible hydraulic fluid to be transferred from tank 26 to volume 66. If gas were admitted into bag 64, the chair seat suspension would have a spongy feel to it, which is undesirable, as explained hereinabove.

In operation, the mechanism functions as follows. Some hydraulic liquid is admitted into bag 64 and fills the volume 71 in bag 64. The remainder of the hydraulic liquid 106 is admitted into chamber 26. Pressurized gas 104 is admitted into chamber 26. When valve 88 is opened, and seat 16 is not occupied the pressure of the gas 104 on incompressible fluid 106 will force the fluid through orifice 100 and orifice 98 into tube 92 from whence it will pass through valve 88, tube 28 and into bag 64. As a greater liquid volume 66 occupies rolling sock diaphragm 64, it will force diaphragm 64 to expand upwardly, enlarging volume 71 and thereby pressing on plug 70 and forcing top support member 81 upwardly together with shaft 32 and support platform 36. Chair seat 16 will therefore move upwardly until valve 88 is closed. When valve 88 is closed, the seat cannot move downwardly because of the incompressibility of fluid 66 in bag 64. As explained hereinabove, bag 64 is constructed to have flexible walls. However, the walls should not stretch, and the material of which diaphragm 64 is constructed must therefore be chosen to be of sufficient thickness to prevent stretching under pressure of fluid in the bag. However, the material must be flexible enough to allow the bag to flex and act as a rolling sock to vary the size of volume 71. A preferable material for diaphragm 64 is neoprene rubber since this material is sufficiently flexible and is resistant to oil. The hydraulic fluid used is preferably water mixed with hydraulic oil.

If it is desired to lower chair seat 16, a weight is placed on the chair seat such as for instance by means of an occupant of the chair and valve 88 is opened. The weight of the occupant will cause pressure on the fluid in volume 71 causing it to flow through opening 79 in plug 70, through tube 28 and valve 88 into tube 92. The fluid pressure on ball 96 will cause ball 96 to seat in orifice 98 whereby the fluid can only pass into tank 26 through orifice 100. Orifice 100 is sized so that the flow through it is sufficiently slow to allow the downward speed of the chair seat to be comfortable for the chair occupant. In addition, the flow should be sufficiently slow so that the occupant can choose the exact position in which he wants to stop the descent of seat 16. If the fluid flow in the downward direction of the chair were made too fast, great coordination would be needed by the occupant to stop the downward movement of the chair at the precise desired point.

What has therefore been provided is a very simple and efficient mechanism for raising and lowering the chair seat. No sliding seals are used in the construction of the mechanism whereby leakage is eliminated. Furthermore, no pumps are needed in order to provide upward movement of the mechanism since the pressurized gas 104 provides the pumping function. Additionally, the control can be located anywhere in the chair including the arm portion of the chair or the side of the chair seat where it is easily accessible to the user. The mechanism can also be incorporated in articles of furniture other than chairs, such as for instance tables, since the tank can be located anywhere in a convenient location so that the mechanism will not be bulky and take up too much space. It can also be seen that in the illustrated chair embodiment the entire upper structure including housing 34, tube 28 and tank 26 rotates with the chair seat. By this arrangement the control and tank can be located remotely in the chair.

The function provided by compressed gas 104 in chamber 26 is to force hydraulic fluid from chamber 26 into bag 64. In some cases it may be possible that alternative embodiments can be provided wherein the fluid transfer function is provided by other means. For instance, a pump could be provided to transfer fluid through conduit 28. Alternatively, chamber 26 could be expandable and means could be provided to expand and collapse chamber 26 so as to transfer fluid between the two chambers.

Turning now to FIGS. 3,4, and 5 an alternate embodiment of the invention is shown as follows. The chambers for containing the hydraulic liquid are arranged concentrically rather than remotely from each other as shown in FIG. 1. Thus, by reference to FIG. 3 it is shown that the arm 18 of the chair does not contain a tank. Tube 28 loops from mechanism 20 upwardly along the bottom of the seat portion of chair 16 and then back to mechanism 20. Control valve 30 in house loop 28 is located at the side of the chair seat portion for easy accessibility by the seat occupant.

Lower cylindrical housing cover 24 and bottom portion 50 thereof are stationary. Stationary support column 40 extends upwardly from the bottom portion in which thrust bearing 38 is provided. End 44 of shaft 40 is received in recess 45 of support member 62. Guide tube 46 surrounds shaft 40 to prevent lateral movement thereof. Diaphragm 64 is enclosed in cylindrical member 56. Diaphragm 64 is sealingly connected to support member 62 with crimp ring 68 and to plug 70 with crimp ring 72. Circumferential chamber 108 surrounds cylinder 56 and is spaced therefrom by means of ring spacers 114, three of which are provided in the illustrated embodiment. Spacers 114 form sleeve bearing surfaces for telescoping cylinder 56. Chamber 108 comprises two cylindrical walls including inner wall 112 and outer wall 110. An upper wall 111 and a lower wall 113 complete chamber 108. Chamber 108 is sealed and contains hydraulic fluid 106 and pressurized gas 104 as indicated. Chamber 108 also has a fitting 102 to allow the addition of hydraulic fluid and pressurized gas to the chamber. A fitting 116 is also provided in an aperture in top wall 111 of chamber 108 for transfer of hydraulic fluid to the chamber. Conduit 28 connects to fitting 116 in a conventional manner such as by the inclusion of ridges on the fitting for engagement with hose loop 28. Flexible conduit 28 connects to connector 84 having ridges 86 thereon as explained hereinabove in connection with FIG. 2. Chamber 108 is rotatingly received in housing cover 24 and is spaced therefrom by means of spacer 48 which forms a sleeve bearing. Spacers 48 can be constructed of plastic as explained hereinabove in connection with FIG. 2.

FIG. 5 shows a sectional view taken along the line 5—5 of FIG. 4 and shows that all parts sectioned by line 5—5 are cylindrical.

In operation, cylindrical inner tube 56 moves as a unit with top support member 81 as fluid is added or removed from volume 66 of bag 64. Rings 114 form bearing surfaces between wall 112 of chamber 108 and tube 56. Control valve 30 comprises a simple pinch-off valve 118, as illustrated. However, it should be understood that valve 30 can comprise any one of a variety of valves including the two speed valve of the embodiment of FIG. 2. Thus, as valve 118 is squeezed by the operator to open the same, fluid will transfer from pressurized chamber 108 through fitting 116 and tube 28 into volume 71. However, if a weight is placed upon the chair seat such as by an occupant, the flow of liquid will be in reverse from volume 71 to chamber 108 when valve 118 is opened.

It should be noted that fitting 116 extends into the bottom portion of chamber 108 so that only liquid will be transferred between the two chambers. It should also be noted that bag 64 contains only liquid. As described hereinabove, if gas were admitted into bag 64 the seat support would have a spongy feel to it, which is undesirable.

Turning now to FIG. 6, an alternate embodiment of the invention is shown wherein the two chambers are disposed in stacked relationship. Then in this embodiment the entire lifting mechanism can be located in the base of the chair or the like. A base 12 is again shown attached to lower cylindrical housing cover 24. Shaft 40 is provided for supporting support member 62 to which a bottom portion of diaphragm 64 is secured by crimp ring 68 as explained hereinabove. The mechanism is shown in its lowermost position. A thrust bearing 38 is provided in the lower portion of housing cover 24 for supporting bottom portion 52 of upper cylindrical housing cover 34. The top portion of diaphragm 64 is secured to plug 70 by means of crimp ring 72. Plug 70 has an aperture 79 therein for permitting hydraulic fluid to flow into and out of volume 71.

Disposed superjacent plug 70 is a separator member 120 having an aperture 121 therein to allow a tube 124 to extend therethrough for enabling hydraulic fluid to be transferred to and from volume 71. A chamber 123 located above separator 120 has side walls 126 to form the sealed chamber 123 including a top wall portion 122. Tubes 116 and 124 are sealingly received in apertures 125 and 127 in top wall 122 for connection to tube 28. Tube 16 extends into the bottom portion of chamber 123 whereby only hydraulic fluid will be transferred between volume 71 and chamber 123. Shaft 32 is secured to top support surface 128 and conduit 28 extends through an opening 130 in upper portion 132 of cylindrical wall 126.

In operation, as pinch-off valve 118 is operated, hydraulic fluid transfers under pressure of gas 104 through tube 116, conduit 28 and tube 124 into volume 71 thereby causing bag 64 to exert an upward force on plug 70 and separator 120. The upward force is transmitted to cylindrical wall 126 whereby cylindrical wall 126, separator 120 and top support surface 128 will rise upwardly. When an occupant is seated in chair seat 16, a downward force on platform 36 and shaft 32 causes a force to be transmitted to plug 70 thereby squeezing bag 64 and forcing the hydraulic fluid to flow in a reverse direction through tube 124, conduit 28 and tube 116 back into chamber 123 and allowing shaft 32 to descend.

It should be understood that while valve 118 is shown schematically as a simple pinch-off valve, it can comprise any one of a variety of valves including the two speed valve of the embodiment of FIG. 2 to control fluid flow through conduit 28 and to enable the transfer of fluid between volume 71 and chamber 123.

As explained above, in some cases it may be possible that alternative means could be provided to transfer fluid from chamber 23 to volume 71, for instance, a pump could be provided. Alternatively, chamber 123 could be constructed to have a variable volume and means could be provided to expand and shrink the volume.

FIG. 7 discloses the embodiment of FIG. 6 with expandable bag 64 in its expanded position. By comparing FIG. 6 with FIG. 7 it can be seen that volume 71 in FIG. 7 is much larger than volume 71 of FIG. 6 and that the bottom portion of bag 64 is not folded back upon itself to the same extent as shown in FIG. 6. It can also be seen that cover 34 and chamber 123 have moved upwardly as a unit under pressure from the hydraulic fluid in volume 71 to support shaft 32 and platform 36 in an elevated position. By reference to this figure it can also be seen that conduit 28 has moved upwardly together with the remainder of the working parts of the mechanism. The walls of bag 64 are in contact with the inside of tank wall 126 so that volume 71 can expand only in the upward direction.

The operation of bag 64 is similar in all embodiments shown. In the interest of clarity, the expanded position of bag 64 has only been shown for the embodiment of FIG. 7. However, by reference to the embodiments of FIGS. 1–5 it can be seen that bag 64 operates the same way in those embodiments as in the embodiment shown in FIGS. 6 and 7.

While this invention has been described as having a preferred design it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A hydraulic lift mechanism for adjustably supporting an article of furniture comprising:

a base;

a reciprocable support member moveable between extended and retracted positions;

a first chamber having a pressurized gas therein;

a second chamber filled with a substantially incompressible liquid and including a flexible wall, the volume of said chamber being variable, said second chamber supported by said base and said support member supported by said second chamber, said support member reciprocating in response to variations in said variable volume;

conduit means connecting said first chamber to said second chamber; and control means in said conduit means for selectively enabling said conduit means to transfer the liquid between said chambers.

2. The mechanism of claim 1 wherein said first chamber contains both a liquid and a gas, said gas being under compression, said conduit means connected to permit only liquid to pass between said chambers.

3. The mechanism of claim 1 wherein said first chamber is positioned remotely from said base and said second chamber.

4. The mechanism of claim 3 wherein said article of furniture comprises a chair and wherein said first chamber is located in an arm rest of said chair.

5. The mechanism of claim 1 wherein said first chamber is concentric with said second chamber.

6. The mechanism of claim 1 wherein said first chamber is disposed intermediate said support member and said second chamber.

7. The mechanism of claim 1 wherein said base includes a bearing means for rotatably supporting said reciprocable member and said second chamber.

8. The mechanism of claim 2 wherein said control means comprises a valve including means for enabling liquid flow from said first chamber to said second chamber at a first flow rate and for enabling liquid flow from said second chamber to said first chamber at a second flow rate, said first flow rate being greater than said second flow rate.

9. The mechanism of claim 8 wherein said valve includes a check valve member and a passage bypassing said check valve.

10. The mechanism of claim 1 wherein said article of furniture is a chair and said control means is located in a portion of the chair remote from said base and support member.

11. The mechanism of claim 10 wherein said control means is received in an arm of said chair.

12. The mechanism of claim 1 wherein said second chamber comprises a flexible diaphragm member sealingly secured to a closure member, said closure member including an aperture for receiving one end of said conduit means.

13. The mechanism of claim 12 wherein said diaphragm member comprises a neoprene rubber diaphragm.

14. A chair height adjustment mechanism comprising:

a base member;

an expandable first hollow member supported on said base, said hollow member comprising a flexible diaphragm wall member, said first hollow member being completely filled with a substantially incompressible liquid;

a vertically reciprocable support member supported on said first hollow member;

a chair seat supported on said support member and vertically reciprocable therewith;

a second hollow member containing a liquid and a pressurized gas, said second hollow member located remote from said first hollow member, said base and said support member;

a hollow conduit connecting said first and second hollow members; and control valve means for selectively enabling said conduit to transfer the incompressible liquid between said two hollow members, whereby the change in the volume of fluid contained in said first hollow member causes said first hollow member to expand or contract thereby causing said chair seat to move vertically.

15. The mechanism of claim 14 wherein said second hollow member is located in an arm of said chair.

16. The mechanism of claim 14 wherein only liquid is transferred between said two hollow members.

17. The mechanism of claim 14 wherein said control valve means is located remote from said base and said support mechanism.

18. The mechanism of claim 14 wherein said control valve means is located in an arm of said chair.

19. The mechanism of claim 14 wherein said valve means enables liquid to be transferred through said conduit at a first rate in a first direction and at at second rate in a second direction.

20. The mechanism of claim 19 wherein said valve means comprises a check valve, a passage for bypassing said check valve, and a control valve in series circuit with said check valve and said bypass passage for enabling fluid flow.

21. The mechanism of claim 14 wherein said flexible diaphragm is comprised of neoprene rubber.

22. The mechanism of claim 14 wherein said base includes a bearing means, said bearing rotatably supporting a support column, said column supporting said first hollow member for rotation with said column.

23. A hydraulic lifting mechanism for supporting articles of furniture comprising:

a base member;

a support column secured to said base;

a variable volume chamber, said chamber supported by said column and containing a substantially incompressible hydraulic liquid, said chamber comprising a flexible bag means;

a support member supported by said variable volume chamber;

a fixed volume chamber means containing a liquid and a pressurized gas and disposed in said article of furniture;

conduit means for connecting said two chambers and for transferring the incompressible liquid therebetween;

control means in said conduit for controlling liquid transfer between said two chambers wherein only liquid is transferred between said chambers, said control means positioned remote from said base and said variable volume chamber.

24. The mechanism of claim 23 wherein said fixed volume chamber is located adjacent said variable volume chamber, said conduit means comprises a flexible tube and said control means comprises means for pinching shut said flexible tube.

25. The mechanism of claim 23 wherein said fixed volume chamber is concentric with said variable volume chamber.

26. The mechanism of claim 23 wherein said fixed volume chamber is located remotely from said variable volume chamber, said conduit means comprises a flexible tube and said control means comprises means for pinching shut said flexible tube.

27. The mechanism of claim 23 wherein said fixed volume chamber is disposed superjacent said variable volume chamber.

28. The mechanism of claim 23 wherein said liquid transfer from said fixed volume chamber to said variable volume chamber occurs at a first flow rate and said liquid transfer from said variable volume chamber to said fixed volume chamber occurs at a second flow rate smaller than said first flow rate, said control means automatically controlling said flow rates.

29. The mechanism of claim 28 wherein said control valve means comprises a check valve and an orifice bypassing said check valve.

30. The mechanism of claim 23 hwerein said article of furniture comprises a chair and wherein said base includes a bearing for rotatably supporting said support column.

31. The mechanism of claim 23 wherein said bag comprises a neoprene rubber diaphragm sealingly secured to a closure member by means of crimp ring.

32. The mechanism of claim 23 wherein said liquid transfer from said fixed volume chamber to said variable volume chamber is effected by said pressurized gas and the transfer from said variable volume chamber to said fixed volume chamber is effected by the weight of an article carried by said support member acting on said variable volume chamber.

33. The mechanism of claim 32 wherein said article furniture comprises a chair.

34. A hydraulic chair lift mechanism comprising:

a base;

a rotatable support member rotatably supported by said base;

a sealed flexible bag member supported by said support member;

chamber means connected to said bag member by a conduit means;

a hydraulic incompressible fluid in said bag and said chamber;

a pressurized gas in said chamber and disposed above said hydraulic fluid;

said conduit means being hollow and adapted to transfer fluid between said bag and said chamber;

control means in said conduit for enabling said fluid transfer;

said fluid transfer from said chamber to said bag being at a first flow rate and said fluid transfer from said bag to said chamber being at a second flow rate, less than said first flow rate.

35. The mechanism of claim 34 wherein said control means comprises a check valve, a bypass means connected in parallel circuit with said check valve and a control valve for enabling and disabling said fluid transfer.

36. The mechanism of claim 34 wherein said control means is located remotely from said base, said bag and said chamber.

37. The mechanism of claim 36 wherein said remotely located control means is received in an arm of said chair.

38. The mechanism of claim 34 wherein said conduit comprises a loop of tubing and wherein said control means is located in said loop at a position remote from said bag, said chamber and said support member.

39. The mechanism accordingly to claim 34 wherein said chamber is located in an arm of said chair and wherein said control means comprises a check valve and an orifice bypassing said check valve, and wherein said check valve and orifice are disposed. in said chamber.

40. The mechanism according to claim 34 wherein said chamber is concentric with said flexible bag.

41. The mechanism according to claim 34 wherein said chamber is superjacent to and supported by said flexible bag.

42. The mechanism according to claim 34 wherein said flexible bag is comprised of neoprene rubber and includes an opening therein, a plug received in said opening and sealingly secured to said bag, said plug member containing an aperture therein for receiving one end of said conduit.

43. The structure according to claim 34 wherein said pressurized gas causes said fluid to flow from said chamber to said bag and wherein the weight of an occupant of said chair causes said fluid to flow from said bag to said chamber.

44. The mechanism according to claim 34 wherein said base includes an upstanding tubular member and wherein said support column comprises a cylindrical tube, said bag enclosed within said tube, said tube telescopically received within said base for reciprocating movement therein.

45. A hydraulic lifting mechanism for lifting a chair seat comprising;

two chambers each containing hydraulic fluid, one of said chambers comprising a flexible rolling sock;

a conduit for interconnecting said chambers, said conduit adapted to transfer said fluid between said chambers;

control means for enabling and disabling said fluid transfer and including a valve; and bypass means for bypassing fluid past said valve.

46. The hydraulic lifting mechanism of claim 45 wherein said valve comprises a check valve and wherein said bypass means comprises a fluid passage, the fluid flow through said opened check valve being greater than the fluid flow through said passage.

47. The hydraulic lifting mechanism of claim 46 wherein said mechanism is adapted to move said chair seat upwardly at a first rate of speed and downwardly at a second rate of speed and wherein said check valve is opened during said upward movement and is closed during said downward movement.

48. A hydraulic lift mechanism for adjustably supporting an ariticle of furniture comprising:

a base;

a reciprocable support member moveable between extended and retracted positions;

a first fluid filled chamber;

a second fluid filled chamber including a flexible wall, the volume of said second chamber being variable, said second chamber supported by said base and said support member supported by said second chamber, said support member reciprocating in response to variations in said variable volume;

conduit means connecting said first chamber to said second chamber; and control means in said conduit means for selectively enabling said conduit to transfer fluid between said chambers;

said first chamber being positioned remotely from said base and said second chamber.

49. The hydraulic lift mechanism of claim 1 wherein said conduit means comprises a conduit having a flexible wall, and said control means comprises means for selectively pinching the flexible wall of said conduit to control the flow of liquid between said chambers.

50. The hydraulic lift mechanism of claim 14 wherein said conduit comprises a flexible wall and said valve means includes means for selectively pinching the flexible wall of the conduit.

51. A chair height adjustment mechanism comprising:

a base member;

a first hollow member supported on said base, said hollow member comprising a flexible diaphragm wall member, said first hollow member containing a liquid;

a vertically reciprocable support member supported on said first hollow member;

a chair seat supported on said support member and vertically reciprocable therewith;

a second hollow member containing a liquid and a pressurized gas, said second hollow member located remote from said first hollow member, said base and said support member;

a hollow conduit connecting said first and second hollow members;

valve means for selectively enabling said conduit to transfer fluid between said two hollow members, whereby the change in the volume of fluid contained in said first hollow member causes said chair seat to move vertically;

said base including a bearing means, said bearing means rotatably supporting a support column, said column supporting said first hollow member for rotation with said column.

* * * * *

UNITED STATES PATENT AND TRADEMARK OFFICE

CERTIFICATE OF CORRECTION

PATENT NO. : 4,593,951

DATED : June 10, 1986

INVENTOR(S) : Mathew A. Slaats et al

It is certified that error appears in the above-identified patent and that said Letters Patent is hereby corrected as shown below:

Claim 1, Col. 12, line 15, after "said" insert --second--.

Claim 19, Col. 13, line 35, change "at" third occurrence to --a--.

Claim 30, Col. 14, line 28, change "hwerein" to --wherein--.

Claim 39, Col. 15, line 15, after "disposed" delete --.--.

Signed and Sealed this

*Twenty-sixth* Day of *August 1986*

[SEAL]

*Attest:*

DONALD J. QUIGG

*Attesting Officer*

*Commissioner of Patents and Trademarks*